United States Patent [19]

Johnson

[11] Patent Number: 4,691,099

[45] Date of Patent: Sep. 1, 1987

[54] SECONDARY CATHODE MICROCHANNEL PLATE TUBE

[75] Inventor: C. B. Johnson, Fort Wayne, Ind.

[73] Assignee: ITT Electro Optical Products, Roanoke, Va.

[21] Appl. No.: 770,446

[22] Filed: Aug. 29, 1985

[51] Int. Cl.[4] ..... H01J 31/50

[52] U.S. Cl. ..... 250/213 VT; 313/528; 313/534; 313/105 CM

[58] Field of Search ..... 250/213 VT, 213 R, 207; 313/528, 530, 532, 534, 541, 524, 103 CM, 105 CM

[56] References Cited

U.S. PATENT DOCUMENTS

| | | | |
|---|---|---|---|
| 3,327,151 | 6/1967 | Adams et al. | 313/534 |
| 3,898,498 | 8/1975 | Stone et al. | 313/528 |
| 3,935,493 | 1/1976 | Brouwer | 313/103 CM |
| 4,339,659 | 7/1982 | Johnson | 250/213 VT |

*Primary Examiner*—Edward P. Westin

*Attorney, Agent, or Firm*—Robert A. Walsh; Mary C. Werner

[57] ABSTRACT

A microchannel plate (MCP) tube comprises a photocathode on the MCP input electrode in addition to the conventional semitransparent cathode on the input window of the tube. The second cathode results in additional light being converted into photoelectrons. It also causes secondary emissions of the photoelectrons already generated at the tube window. These phenomena result in higher gain and signal-to-noise ratios for the tube. The second photocathode can employ a coating which is unstable in air to chemically combine with ions traveling in the backstream direction which would otherwise damage the cathode on the tube input window. Its construction can also be such as to function effectively as a trap or "getter" for neutral particles traveling back towards the input window.

9 Claims, 4 Drawing Figures

SECONDARY CATHODE MICROCHANNEL PLATE TUBE

BACKGROUND OF THE INVENTION

This invention relates to microchannel plate tubes such as image intensifiers and photomultipliers.

FIG. 1 of the article "Miniature imaging photon detectors" (J. Phys. E. Sci. Instrum., Vol. 13, 1980, Great Britain) discloses an arrangement where the photocathode appears on the input of a microchannel plate. However, no cathode is shown on the input window of the imaging photon device. In fact, FIG. 1 teaches away from having a cathode on the input window since the dimensions shown therein are such that focusing a light beam on the input window would cause it to be out of focus at the microchannel plate, and vice versa. FIG. 4 of this article and FIG. 1 of the article "Miniature imaging photon detectors II. Devices with transparent photocathodes" (J. Phys. E. Sci. Instrum., Vol. 14, 1981, Great Britain) show the same basic arrangement, and would have the same focusing problems even if a photo cathode were contemplated on the input window of the imaging photon detectors. The article "Miniature imaging photon detectors III. An assessment of the performance of the resistive anode IPD" (J. Phys. E. Sci. Instrum., Vol. 15, 1982, Great Britain) performance of the resistive anode IPD" further discusses the photon detectors in the aforementioned two articles.

U.S. Pat. No. 4,339,659, issued July 13, 1982, to C. B. Johnson, the inventor of the subject invention, discloses an image converter wherein radiant energy passes through a window to impinge on a photocathode which is formed on a radiant energy sensitive phosphor that is in turn deposited on the input electrode of a microchannel plate. However, there is no statement or suggestion in the patent of having a photocathode on the input window.

Well known in the art are microchannel plate tubes with a photocathode on the tube input window. However, such tubes do not have an additional photocathode placed on the microchannel plate input.

SUMMARY OF THE INVENTION

An object of the present invention is to provide a microchannel plate tube with enhanced gain, improved photoemission efficiency, and a higher signal-to-noise ratio.

Another object of the present invention is to provide a microchannel plate tube with a means for lessening the number of neutral particles and ions which travel in a direction opposite of that of the photoelectron current and thus impinge on the tube input window cathode.

Still another object of the present invention is to provide a means for increasing secondary photoelectron emission in an MCP tube.

The above objects are attained by providing an MCP tube having a cathode mounted directly on the input of the microchannel plate input electrode in addition to the conventional cathode on the tube input window. The cathode on the microchannel plate input electrode functions to convert light rays which are passed through the tube input window into photoelectrons, to create the secondary emission of photoelectrons which have been generated at the tube input window, and to trap neutral particles and ions and thus prevent their traveling back toward the tube input window.

DETAILED DESCRIPTION OF THE INVENTION

Figure 1:
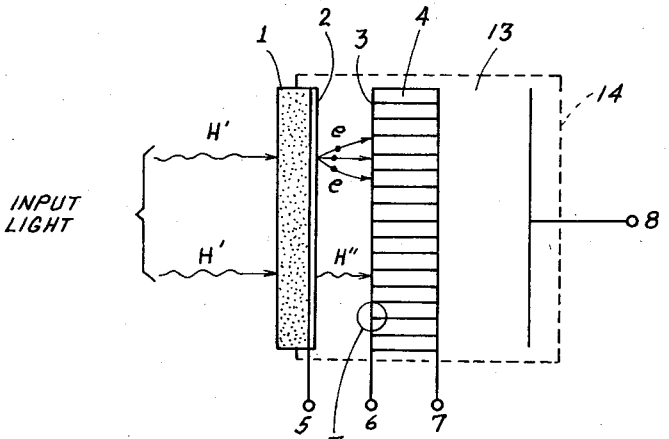
FIG. 1 is a schematic of the MCP tube of the present invention.

FIG. 1 shows input light rays H′ impinging on the input window 1 of microchannel plate tube 13. Some of the light rays which impinge on the photocathode 2 mounted on input window 1 are converted into photoelectrons e. These photoelectrons e travel together with unconverted light rays H″ within the vacuum envelope 14 of the tube 13 to impinge on photocathode 3 which is mounted on the microchannel plate array 4. Photocathode 3 functions to both convert some of the light rays H″ into photoelectrons and to cause secondary emission of the previously generated photoelectrons e. The photoelectrons are accelerated through the microchannel plate by electrode 7 and leave the microchannel plate array to impinge on anode 8. To accelerate the photoelectrons, electrode 6 is made positive relative to electrode 5 and electrode 7 is made positive to electrode 6. Likewise, electrode 8 is positive relative to electrode 7.

Figure 2:
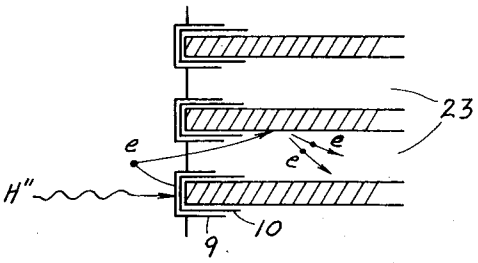
FIG. 2 is a schematic of one embodiment of the microchannel plate of the present invention which is an enlarged view of the area J of FIG. 1.

FIG. 2 shows an embodiment of the invention comprising a flat photocathode 9 and electrode 10. H″ designate input light rays which have passed through the tube window and e designates the photoelectrons generated at the photocathode 9.

Figure 3:
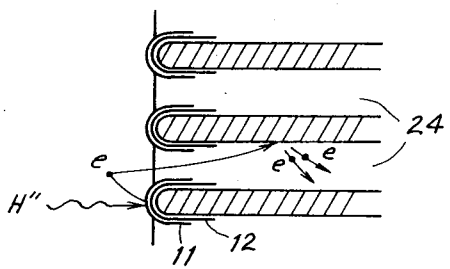
FIG. 3 is a schematic of another embodiment of the microchannel plate of the present invention which is also an enlarged view of the area J of FIG. 1.

The photocathode 11 and electrode 12 in FIG. 3 are analogous to elements 9 and 10 in FIG. 2. However, the funnel shape of the photocathode and electrode of FIG. 3, as opposed to the flat shaped cathode and electrode in FIG. 2, provides a shorter path for photoelectrons generated at the photocathode to reach the channels 24 of the microchannel plate array and cause secondary emission of photoelectrons. There is therefore a greater likelihood of photoelectrons generated at the photocathode 11 going into the channels 24 of the microplate array than is the case with electrons generated at flat photocathode 9 going into channels 23. Thus, the funnel shaped construction enhances the gain of the tube.

Figure 4:
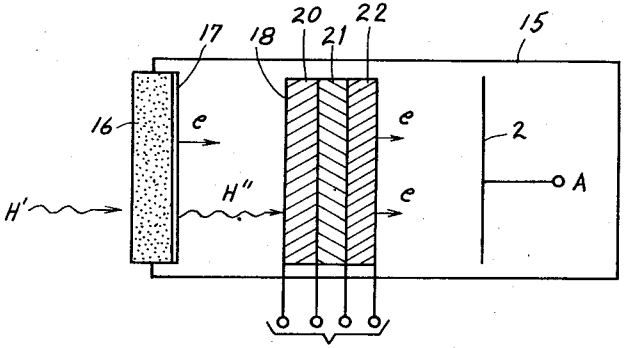
FIG. 4 is a schematic of an embodiment of the invention wherein a plurality of microchannel plates are cascaded.

FIG. 4 shows an embodiment of the invention where a number of microchannel plate arrays 20, 21, 22 are connected in series with each other and anode 15. The gettering capability of photocathode 18 and the other MCP input photocathode can be enhanced by using a compound which is unstable in air such as cesium antimony (CsSb). Such a material creates the possibility of ions which are flowing back towards photocathode 17 chemically combining with the material of photocathode 18 so as not to impinge on photocathode 17. The MCP input photocathodes also trap neutral particles heading toward the input window photocathode.

With regard to the MCP electrodes 6, 10, 12 and 19 respectively shown in FIGS. 1, 2, 3 and 4, it has been found that highly reflective aluminum functions well as a material for these electrodes which are coated on the microchannel plate inputs. The aluminum has been found to enhance secondary emission of photoelectrons.

Embodiments of the present invention have been built and tested successfully for inputs of ultraviolet light. Cesium Iodide (CsI) has been found to be a suitable material for the photocathode. Embodiments of the invention could, of course, be developed for use with light of other wavelengths by using suitable photocathode materials.

While the principles of the invention have been described in connection with specific apparatus it is to be clearly understood that this description is made only by way of example and not as a limitation to the scope of the invention as set forth within the objects thereof and in the accompanying claims.

I claim:

1. A radiant energy microchannel plate tube comprising:

a tube envelope;

a tube input window mounted in said envelope;

a first photocathode mounted on said input window;

a microchannel plate array mounted within said tube envelope and spaced from said tube input window with its input facing said input window; and a second photocathode mounted on said microchannel plate input and spaced from said tube input window.

2. The radiant energy microchannel plate tube of claim 1 wherein said second photocathode is composed of cesium antimony (CsSb).

3. The radiant energy microchannel plate tube of claim 1 wherein said first photocathode is composed of cesium iodide (CsI).

4. The radiant energy microchannel plate tube of claim 1 wherein said microchannel plate array comprises an input electrode composed of highly reflective aluminum.

5. The radiant energy microchannel plate tube of claim 1 further comprising one or more additional microchannel plate arrays connected in series with said microchannel plate array.

6. The radiant energy microchannel plate tube of claim 1, wherein said energy is in the ultraviolet light spectral region.

7. The radiant energy microchannel plate tube of claim 1, wherein said energy is in the visible light spectral region.

8. The radiant energy microchannel plate tube of claim 1 wherein said second photocathode comprises a plurality of elements substantially parallel to said tube input window said elements having other elements integrally connected at their ends at subtantially right angles and extending into adjacent channels of said microchannel plate array.

9. The radiant energy microchannel plate tube of claim 1 wherein said second photocathode comprises a plurality of arcuate shaped elements with the apex of each arcuate shaped element being the part of that element nearest to said input window, said arcuate shaped elements having other elements integrally connected thereto at their ends and extending into adjacent channels of said microchannel plate array.

* * * * *